US005702272A

United States Patent [19]

Machida

[11] Patent Number: 5,702,272

[45] Date of Patent: Dec. 30, 1997

[54] CONNECTING TERMINAL AND METHOD OR MANUFACTURING THE SAME

[75] Inventor: Yukihumi Machida, Tokyo, Japan

[73] Assignee: Ryosei Electro-Circuit Systems, Ltd., Tokyo, Japan

[21] Appl. No.: 446,718

[22] PCT Filed: Sep. 30, 1994

[86] PCT No.: PCT/JP94/01638

§ 371 Date: May 30, 1995

§ 102(e) Date: May 30, 1995

[87] PCT Pub. No.: WO95/10128

PCT Pub. Date: Apr. 13, 1995

[30] Foreign Application Priority Data

Jan. 10, 1993 [JP] Japan ..... 5-269969
Jan. 10, 1993 [JP] Japan ..... 5-269970

[51] Int. Cl.[6] ..... H01R 15/10

[52] U.S. Cl. ..... 439/843; 439/852; 439/861

[58] Field of Search ..... 29/874, 884; 439/885, 439/851–857, 861, 862, 842, 843

[56] References Cited

U.S. PATENT DOCUMENTS 5,158,485 10/1992 Saito et al. ..... 439/843
5,186,664 2/1993 Abe ..... 439/843
5,226,842 7/1993 Endo et al. ..... 439/843
5,271,741 12/1993 Saito et al. ..... 439/843

FOREIGN PATENT DOCUMENTS 59-39876 5/1984 Japan .
1-155673 6/1989 Japan .
2-22516 5/1990 Japan .
5-251156 9/1993 Japan .

OTHER PUBLICATIONS

International Search Report for International Application No. PCT/JP94/01638.

*Primary Examiner*—J. J. Swann
*Attorney, Agent, or Firm*—Varndell Legal Group

[57] ABSTRACT

A terminal connecting portion 22 of a connecting terminal 21 is formed in a form of a rectangular sleeve by a bottom plate 24, side plates 25, 26 bent upwardly from the bottom plate 24, and top plates 27, 28 bent horizontally from respective side plates 25, 26. Within the terminal connecting portion there is provided a movable contact strip 29 such that a contact portion 29*a* is directed toward the top plate 27, engaging projections 29*b*, 29*c* provided at a front portion of the movable contact strip 29 are engaged with wing portions 30*b* of a clamping strip 30, and engaging lugs 29*d*, 29*e* formed at the front portion of the movable contact strip 29 are engaged with front edges of the side plates 25, 26.

2 Claims, 7 Drawing Sheets

CONNECTING TERMINAL AND METHOD OR MANUFACTURING THE SAME

FIELD OF THE INVENTION

The present invention relates to a connecting terminal into which a cooperating connecting terminal is inserted, and a method of manufacturing such a connecting terminal.

TECHNICAL BACKGROUND

Figure 1:
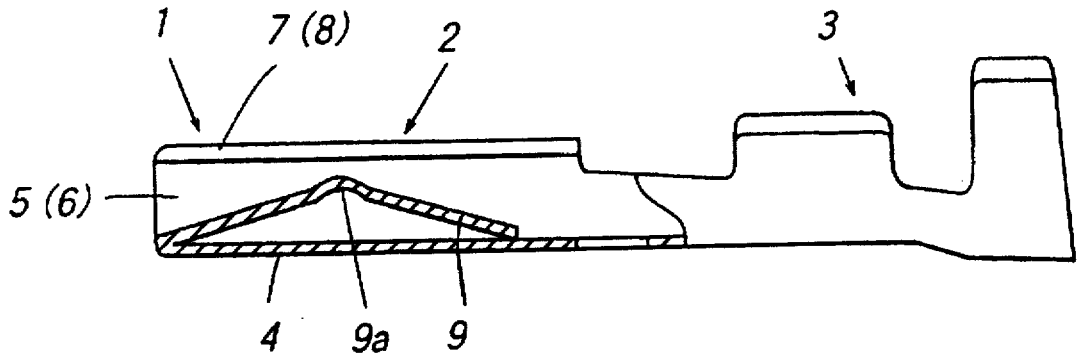
FIG. 1 is a partial cross sectional view showing a first example of a known connecting terminal.

A first example of a known connecting terminal of a kind mentioned in the preamble has been described in, for instance Japanese Patent Application Publication Kokai Sho 61-165970, which is manufactured by blanking or punching an electrically conductive metal plate and then by bending or folding the thus blanked or punched plate. As shown in FIG. 1, the connecting terminal 1 is consisting of a terminal connecting portion 2 and an electric wire clamping portion 3, said terminal connecting portion 2 is surrounded by a bottom plate 4, side plates 5 and 6 projecting from both sides of the bottom plate and top plates 7 and 8 which extend horizontally from the side plates 5 and 6. A movable contact strip 9 having a contact portion 9*a* is folded back from a front end of the bottom plate 4 toward inside of the terminal connecting portion 2.

Figure 2:
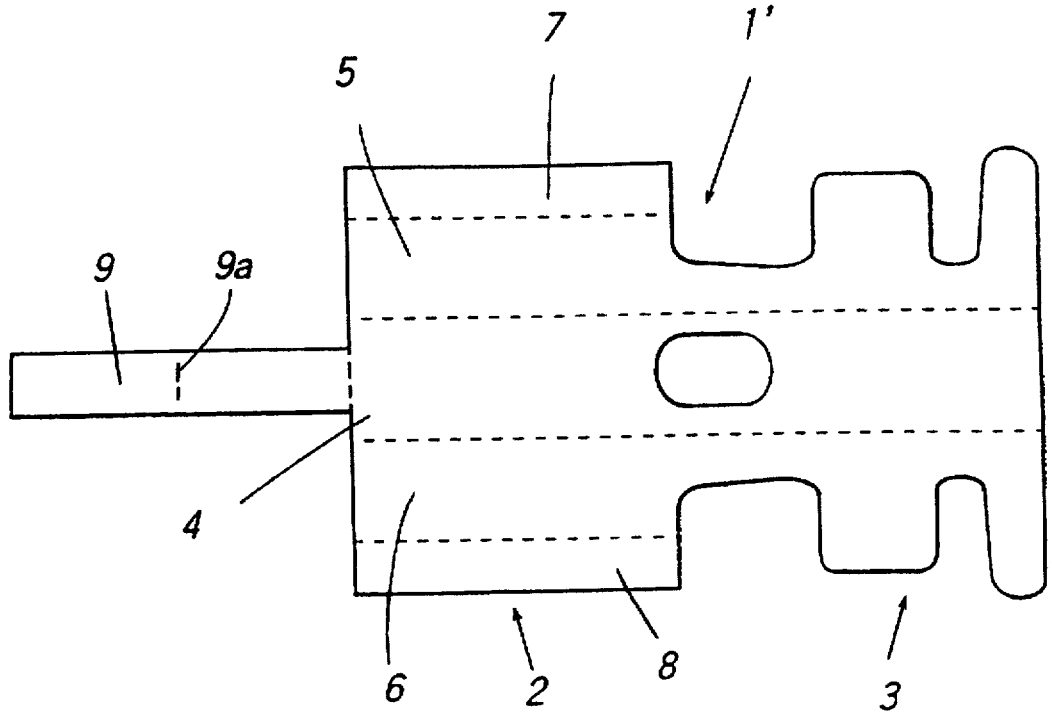
FIG. 2 is a plan view illustrating a blanked or blanked plate of the first example.

FIG. 2 is a plan view of a blanked plate 1' of the connecting terminal 1 formed by a punching process prior to a folding process. In the blanked plate, there are formed the terminal connecting portion 2 and wire clamping portion 3. In the terminal connecting portion 2, there are formed the bottom plate 4, side plates 5 and 6 extending from the sides of the bottom plate 4, top plates 7 and 8 extending form the sides of the side plates 5 and 6, and movable contact strip 9 extending from the front edge of the bottom plate 4.

In a next folding process, the thus blanked plate 1' is folded along broken lines. At first, the movable contact strip 9 is folded in a shape of an inverted mountain to form the contact portion 9*a*, and then the movable contact strip is folded over the bottom plate 4. Then, the remaining portions are folded.

Figure 3:
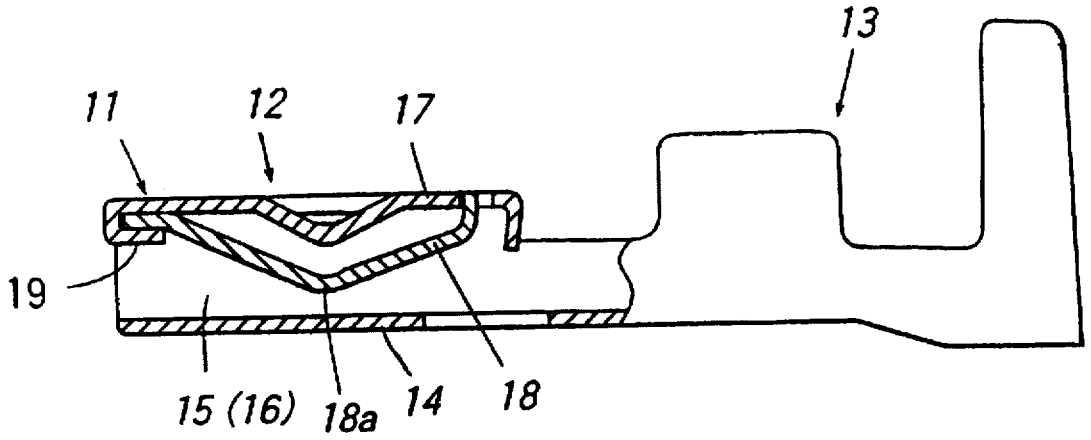
FIG. 3 is a partial cross sectional view depicting a second example of a known connecting terminal.

In Japanese Patent Application Laid-open Publication Kokai Hei 3-93175, there is proposed a second example of a known connecting terminal, in which a loss of material can be reduced. As illustrated in FIG. 3, the connecting terminal 11 comprises a terminal connecting portion 12 and an electric wire clamping portion 13, said terminal connecting portion being surrounded by a bottom plate 14, side plates 15 and 16, and a top plate 17. Within the terminal connecting portion 12, a movable contact strip 18 having a contact portion 18*a* is folded from a side of the top plate 17 toward inside of the top plate and a front end of the movable contact strip 18 is held by clamping strip 19.

Figure 4:
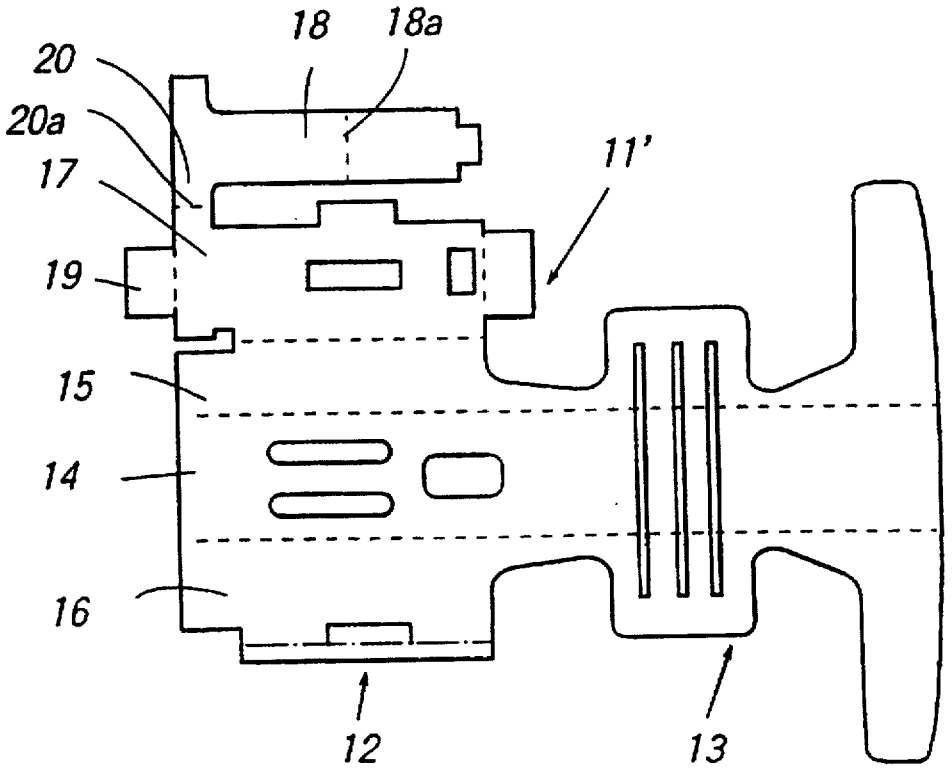
FIG. 4 is a plan view showing a blanked plate of the second example of the connecting terminal.

FIG. 4 is a plan view showing a blanked plate 11' of the connecting terminal 11. There are formed the terminal connecting portion 12 and electric wire clamping portion 13, and the terminal connecting portion 12 including the bottom plate 14, the side plates 15 and 16 extending from both sides of the bottom plate 14, the top plate 17 extending from one of the side plates 15, the movable contact strip 18 extending from one side of the top plate 17, and the clamping strip 19 extending from a front end of the top plate 17.

The movable contact strip 18 is connected to a side of a front end portion of the top plate 17 via a bridging strip 20. The thus blanked plate 11' is folded along broken lines. At first, the movable contract strip 18 is folded into a shape of an inverted mountain to form the contact portion 18*a*, and then is folded back onto the top plate 17 along a fold back portion 20*a*. Next the remaining portions are folded to form the connecting terminal. The first example of the known connecting terminal has problems that the movable contact strip 9 is folded from a front end of the bottom plate 4, and thus it is required to use a starting metal plate having a large width and further portions of the metal plate on both sides of the movable contact strip 9 are wasted.

The second example of the known connecting terminal has problems that the movable contact strip 18 is folded back onto the top plate 17, so that the application of the connecting terminal is limited. That is, depending upon a positional relationship with respect to a connecting terminal which is inserted into this connecting terminal, it is required to provide the movable contact strip 18 on the side of the bottom plate 14, but the second example could not be formed in such a configuration.

A first object of the present invention is to provide a connecting terminal, in which the above mentioned problems can be removed and the movable contact strip is provided on the side of the bottom plate and furthermore a displacement of the movable contact strip can be prevented.

A second object of the present invention is to provide a method of manufacturing a connecting terminal, in which the movable contact can be provided on the side of the bottom plate and a displacement of the movable contact strip can be prevented.

DISCLOLSURE OF THE INVENTION

In a connecting terminal according to a first aspect of the present invention, engaging projections of a movable contact strip having a contact portion facing to a top plate are engaged with engaging portions provided on side plates. A cooperating connecting terminal can be received between the top plate and the movable contact strip.

In a connecting terminal according to a second aspect of the present invention, engaging projections of a movable contact strip having a contact portion facing to a top plate are engaged with an engaging portion provided on a bottom plate. A cooperating connecting terminal can be received between the top plate and the movable contact strip.

In a method of manufacturing a connecting terminal according to the invention, after a single electrically conductive metal plate is blanked or punched into a given shape, a movable contact strip extending from a side of a top plate or a side plate is folded back onto a bottom plate by folding a bridging portion, both side plates are folded upright such that engaging projections formed on the movable contact strip are engaged with engaging portions formed in the side plates, the top plate is folded horizontally, and then the bridging portion is cut.

BEST MODES FOR CARRYING OUT THE INVENTION

Now the present invention will be explained in detail with reference to embodiments shown in FIGS. 5 to 14.

Figure 5:
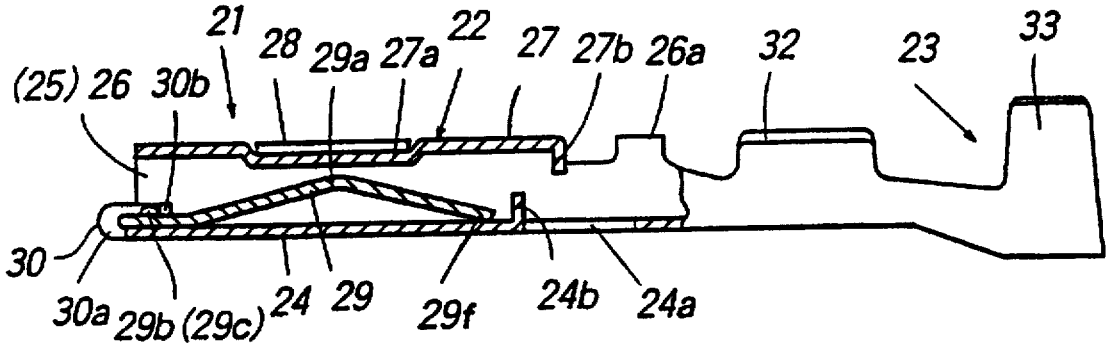
FIG. 5 is a partial cross sectional view depicting a first embodiment of the connecting terminal according to the invention.
Figure 6:
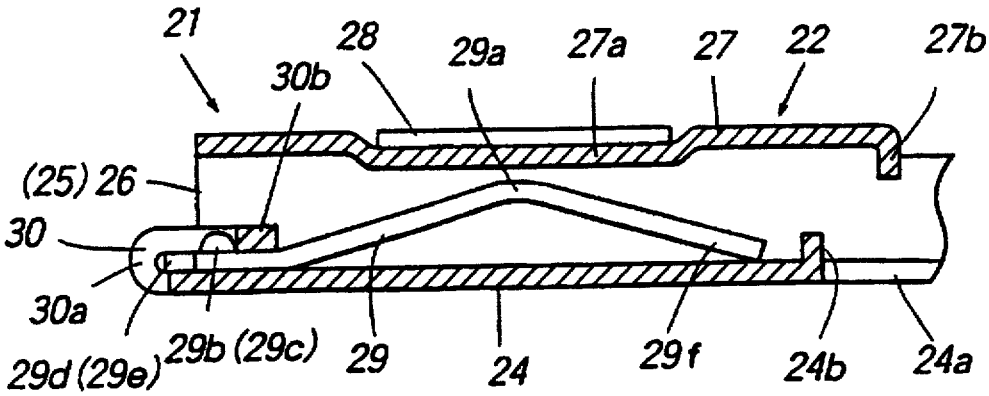
FIG. 6 is an enlarged view illustrating a main portion of the first embodiment.
Figure 7:
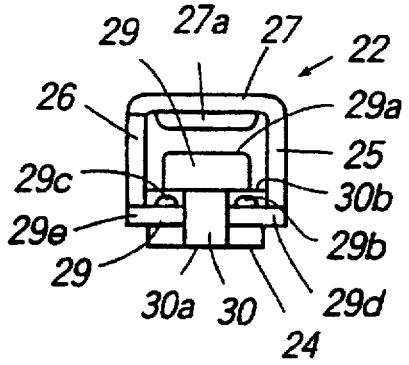
FIG. 7 is a front view of the first embodiment.

FIGS. 5 to 7 illustrate a first embodiment of the connecting terminal according to the invention. A connecting terminal 21 is formed by folding a single blanked metal plate. At a front portion of the connecting terminal, there is provided a terminal connecting portion 22 which receives a cooperating connecting terminal, and at a rear portion there is formed an electric wire clamping portion 23 for clamping a core conductor and a covered conductor is formed. The terminal connecting portion 22 is formed in a shape of a rectangular sleeve by means of a bottom plate 24, side plates 25 and 26 each extending upright from respective sides of the bottom plate 24, and top plates 27 and 28 each extending horizontally from side of respective side plates 25 and 26. The top plate 28 is coupled with a depressed portion 27*a* formed in the top plate 27.

Within the terminal connecting portion 22, a movable contact strip 29 is provided on the bottom plate 24, said movable contact portion being bent in a shape of a mountain to form a contact portion 29*a*. Two hemispherical engaging projections 29*b* and 29*c* are formed on the movable contact strip 29 such that said projections extend upwardly. Further engaging lugs 29*d* and 29*e* are formed at a front end portion of the movable contact strip 29 such that these lugs extend outwardly from a front end portion of the bottom plate 24. A clamping strip 30 is formed in a substantially T-shaped configuration including a base portion 30*a* and wing portions 30*b* extending from both sides of the base portion. When the clamping strip 30 is folded over the front end portion of the movable contact strip 29, the engaging projections 29*b* and 29*c* are engaged with the wing portions 30*b*, and further the engaging lugs 29*d* and 29*e* of the movable contact strip 29 are engaged with front portions of the side plates 25 and 26. In this manner, a backward movement of the movable contact strip 29 can be prevented.

At a rear portion of the bottom plate 24 there are formed a cut-out hole 24*a* and an upwardly bent portion 24*b*, and at a rear portion of the top plate 27 there is formed downwardly bent portion 27*b*. In the electric wire clamping portion 23 there are formed U-shaped core conductor clamping lugs 32 and U-shaped covered wire clamping lugs 33.

Figure 8:
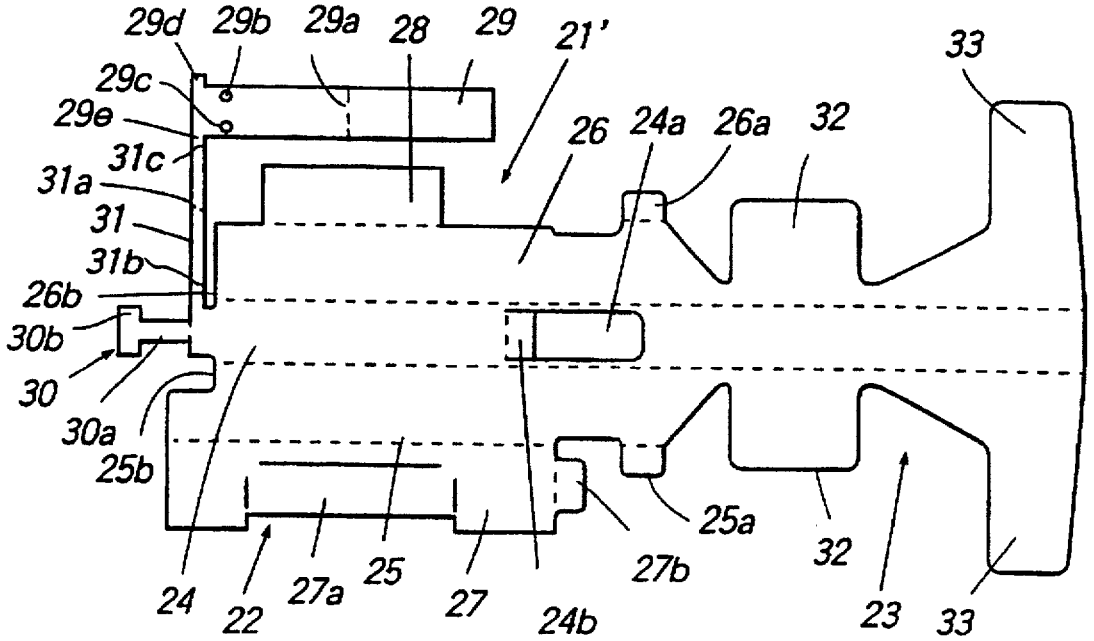
FIG. 8 is a plan view showing a blanked plate of the first embodiment.

FIG. 8 is a plan view showing a blanked plate 21' of the connecting terminal 21 prior to a folding process. The blanked plate comprises the front terminal connecting portion 22 and rear electric wire clamping portion 23. In the terminal connecting portion 22 there are formed the bottom plate 24, the side plates 25 and 26 each extending from respective sides of the bottom plate 24, and the top plates 27 and 28 extending from side of the side plates 25 and 26, respectively. The movable contact strip 29 having the contact portion 29*a* is formed to be extended from a side of the top plate 28. The substantially T-shaped clamping strip 30 is formed to be extended from a front end of the bottom plate 24, and the movable contact strip 29 is formed to be coupled with a root portion of the clamping strip 30 via a bridging portion 31.

At a rear portion of the bottom plate 24 there are formed the cut-out hole 24*a* and upwardly bent portion 24*b*, and at rear portions of the side plates 25 and 26 there are formed stabilizing lugs 25*a* and 26*a*, respectively. In one of the top plates 27 there is formed the depressed portion 27*a* onto which the other top plate 28 is connected, and at a rear portion of the top plate 27 there is formed the downwardly bent portion 27*b*. Furthermore, at a front end of the movable contact strip 29 there are formed the two engaging projections 29*b* and 29*c* such that they extend downwardly viewed on a plane of the drawing of FIG. 8. In the electric wire clamping portion 23 there are formed the core conductor clamping lugs 32 and covered wire clamping lugs 33.

At first, the movable contact strip 29 is bent at the contact portion 29*a* into an inverted mountain shape, and then the movable contact strip 29 is folded over the bottom plate 24 at a folding portion 31*a* in the bridging portion 31. Next, the clamping strip 30 is folded over a front portion of the movable contact strip 29 such that the engaging projections 29*b* and 29*c* are engaged with the wing portions 30*b* of the clamping strip 30 and the engaging lugs 29*d* and 29*e* are positioned in front of front edges 25*b* and 26*b* of the side plates 25 and 26, respectively Then, both the side plates 25 and 26 are bent upright so that the engaging lugs 29*d* and 29*e* of the movable contact plate 29 are engaged with the front edges 25*b* and 26*b* of the side plates 25 and 26, respectively. Next, the top plate 27 is bent horizontally and then the top plate 28 is bent into the depressed portion 27*a* of the top plate 27. In this manner, the terminal connecting portion 22 is constructed in a form of a sleeve having a rectangular cross section. Then, the folded bridging portion 31 is cut off at cut portions 31*b* and 31*c*.

It should be noted that during the above mentioned folding process, the portions 24*b* and 27*b* are formed by bending lugs into given directions, and the stabilizing lugs 25*a* and 26*a* are folded outwardly. In the connecting terminal 21 thus formed, when a cooperating connecting terminal not shown is inserted between the top plate 27 and the movable contact strip 29, the contact portion 29*a* of the movable contact strip 29 is pushed backwardly, i.e. in an inserting direction of the cooperating connecting terminal and the movable contact strip 29 is resiliently bent so that a free end 29*f* of the movable contact strip 29 slides on the bottom plate 24. In this case, the engaging lugs 29*b* and 29*c* of the movable contact strip 29 are engaged with the wing portions 30*b* of the clamping strip 30 and at the same time the engaging lugs 29*d* and 29*e* of the movable contact strip 29 are engaged with the front edges 25*b* and 26*b* of the side plates 25 and 26, respectively, and therefore the backward displacement of the movable contact strip 29 can be positively prevented. Further, any excessive bending of the movable contact strip 29 can be prevented by the upwardly bent portion 24*b*.

It should be noted that the movable contact strip 29 is clamped by means of the engaging projections 29*b*, 29*c* and engaging lugs 29d, 29e, but according to the invention only one of these engaging members may be provided.

Figure 9:
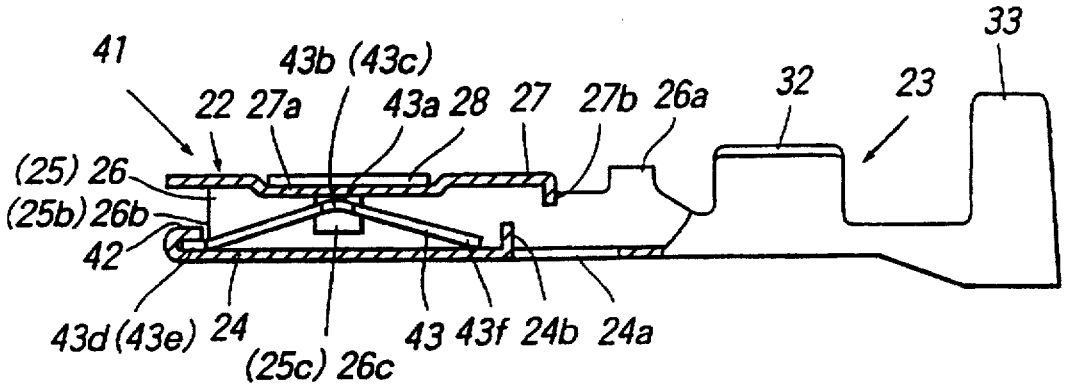
FIG. 9 is a partial cross sectional view illustrating a second embodiment of the connecting terminal according to the invention.

FIG. 9 is a partial cross sectional view showing a second embodiment of the connecting terminal according to the invention. As compared with the first embodiment, the clamping strip 30 is formed as a rectangular clamping lug 42, the engaging projections 29b and 29c of the movable contact strip 29 are deleted and a movable contact strip 42 has formed therein lugs 43b and 43c at a middle portion and engaging lugs 43d and 43e at a front end portion. The clamping lug 42 is folded over a front edge of the movable contact strip 43, the lugs 43b and 43c are freely inserted into window portions 25c and 26c formed in side plates 25 and 26, respectively, and further engaging lugs 43d and 43e are engaged with front edges 25b and 26b of the side plates 25 and 26, respectively.

Figure 10:
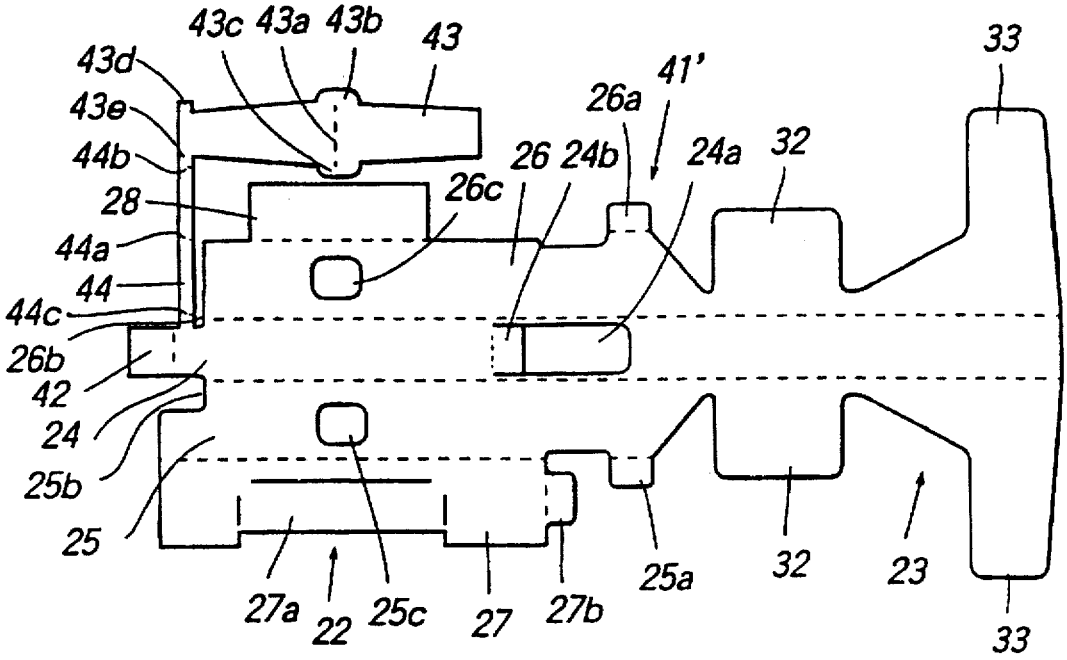
FIG. 10 is a plan view showing a blanked plate of the second embodiment.

FIG. 10 is a plan view illustrating a blanked metal plate 41' of the above mentioned connecting terminal prior to the folding process. The rectangular clamping lug 42 is formed to extend from a front edge of the bottom plate 24 and the movable contact strip 43 is formed to be coupled with a side of the front edge of the bottom plate 24 by means of a bridging strip 44. In the movable contact strip 43 there are formed the engaging lugs 43d and 43e at a front end portion thereof as well as the lugs 43b and 43c at a middle portion thereof such that a distance between outer edges of these lugs is slightly larger than a width of the bottom plate 24.

At first, the movable contact strip 43 is bent at the contact portion 43a in a shape of an inverted mountain, and then the bridging portion 44 is folded at a folding portion 44a so that the movable contact strip 43 is placed over the bottom plate 24. Next, the clamping lug 42 is folded back onto the front edge portion of the movable contact strip 43, and the side plates 25 and 26 are bent upwardly from both sides of the bottom plate 24 such that the lugs 43b and 43c of the movable contact strip 43 are freely inserted into the window portions 25c and 26c of the side plates 25 and 26, respectively and the engaging lugs 43d and 43e are engaged with the front edges 25b and 26b of the side plates 25 and 26, respectively. Thereafter, the blanked plate is folded in a manner similar to the first embodiment and the bridging strip 44 is cut off at the cutting portions 44b and 44c.

In the connecting terminal of the second embodiment, when a cooperating connecting terminal not shown is inserted between the top plate 27 and the movable contact strip 43, the contact portion 43a of the movable contact strip 43 is pushed backwardly as well as downwardly, so that the movable contact strip 43 is resiliently bent and the lugs 43b and 43c are moved downward within the window portions 25c and 26c, respectively. In this case, the backward movement of the movable contact strip 43 is limited by the engagement of the engaging lugs 43d and 43e with the front edges 25b and 26b of the side plates 25 and 26, respectively. Then, a free end 43f slides on the bottom plate 24 and an excessive bending of the movable contact strip 43 can be suppressed by means of the window portions 25c, 26c and the upwardly bent portion 24b.

In the second embodiment, the movable contact strip 43 is provided near the top plate 28 in the blanked plate 41' as shown in FIG. 10, but according to the invention, only one of the top plates 27 and 28 may be provided. In such a case, the movable contact strip 43 may be provided near the side plate 26 or 25.

Figure 11:
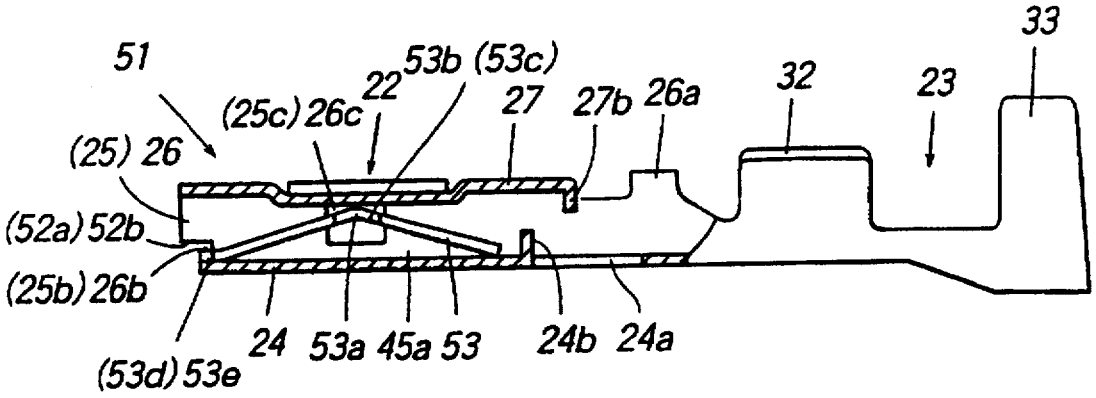
FIG. 11 is a partial cross sectional view depicting a third embodiment of the connecting terminal according to the invention.

FIG. 11 is a partial cross sectional view depicting a third embodiment of the connecting terminal according to the invention. As compared with the second embodiment, in a present connecting terminal 51, the clamping lug 42 is deleted, recesses 52a and 52b are formed between the bottom plate 24 and the side plates 25, 26, and a movable contact strip 53 with a contact portion 53a has formed therein engaging lugs 53c and 53e at front edges thereof in addition to engaging lugs 53b and 53c at sides of a middle portion thereof. The engaging lugs 53d and 53d are positioned in front of the front edges 25b and 26b of the side plates 25 and 26, respectively at the recesses 52a and 52b.

Figure 12:
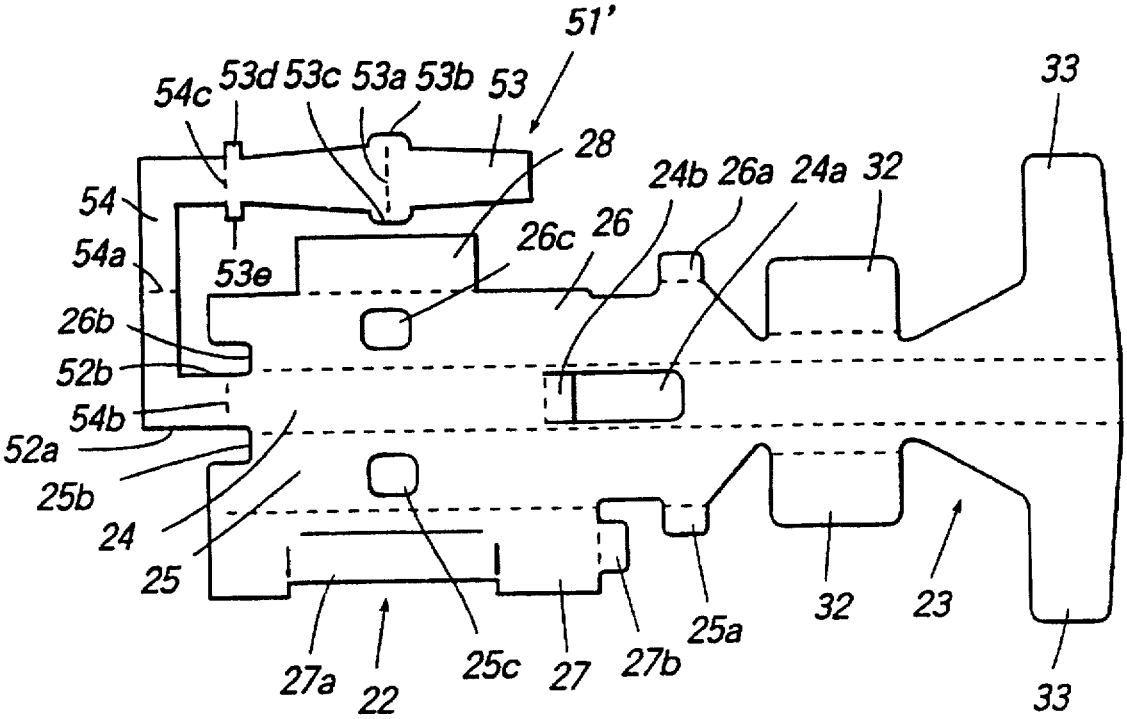
FIG. 12 is a plan view illustrating a blanked plate of the third embodiment.

FIG. 12 is a plan view showing a blanked plate 51' of the connecting terminal 51 prior to the folding process. The recesses 52a and 52b are formed at front end portions of the side plates 25 and 26 between the side plates and the bottom plate 24, and the movable contact strip 53 having the contact portion 53a is coupled with a side of the top plate 28 by means of a bridging strip 54. At first, the movable contact strip 53 is bent at the contact portion 53a into a shape of an inverted mountain, and then is folded back onto the bottom plate 24 by bending the bridging strip 54 at a folding back portion 54a, the side plates 25 and 26 are bend upwardly, the lugs 53b and 53c are freely inserted into the window portions 25c and 26c, respectively, and the engaging lugs 53d and 53e are engaged with the recesses 52a and 52b, respectively. Then, the punched plate is folded in a similar manner to that of the second embodiment, and the bridging strip 54 is cut off at cut-off portions 54b and 54c.

In the third embodiment, the engagement for the forward movement of the front edge of the movable contact strip 53 is not provided, but the engagement for the backward movement and other functions can be attained in a similar manner to the second embodiment.

Figure 13:
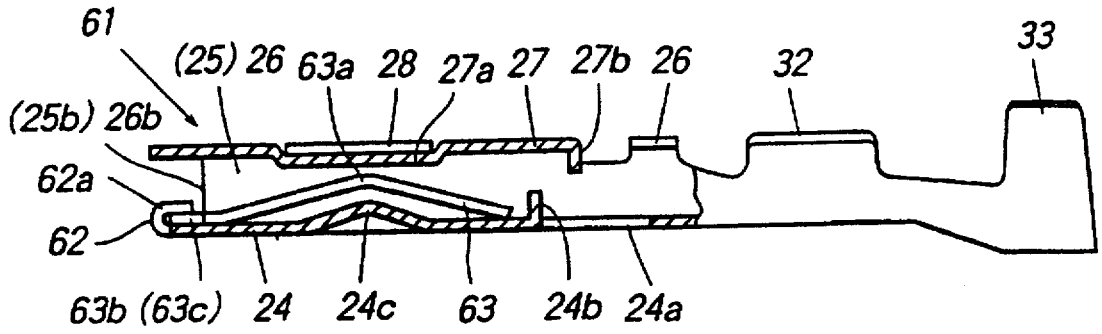
FIG. 13 is a cross sectional view of a main portion of a fourth embodiment.

FIG. 13 is a partial cross sectional view illustrating a fourth embodiment of the connecting terminal according to the invention. In a connecting terminal 61 of the present embodiment, the bottom plate 24 has formed therein a restricting portion 24c which is projected inwardly, and the front edge of the bottom plate 24 has formed therein two clamping lugs 62 having a guide groove 62a formed therebetween, said guide groove serving to guide a downwardly projecting rib of a cooperating connecting terminal. Further the front edge of a movable contact strip 63 including a contact portion 63a has formed therein engaging lugs 63b and 63c, and front edges of side plates 25 and 26 have formed therein front end portions 25b and 26b which are engaged with the engaging lugs 63b and 63c, respectively. The clamping lugs 62 are folded over the front end portion of the movable contact strip 63.

Figure 14:
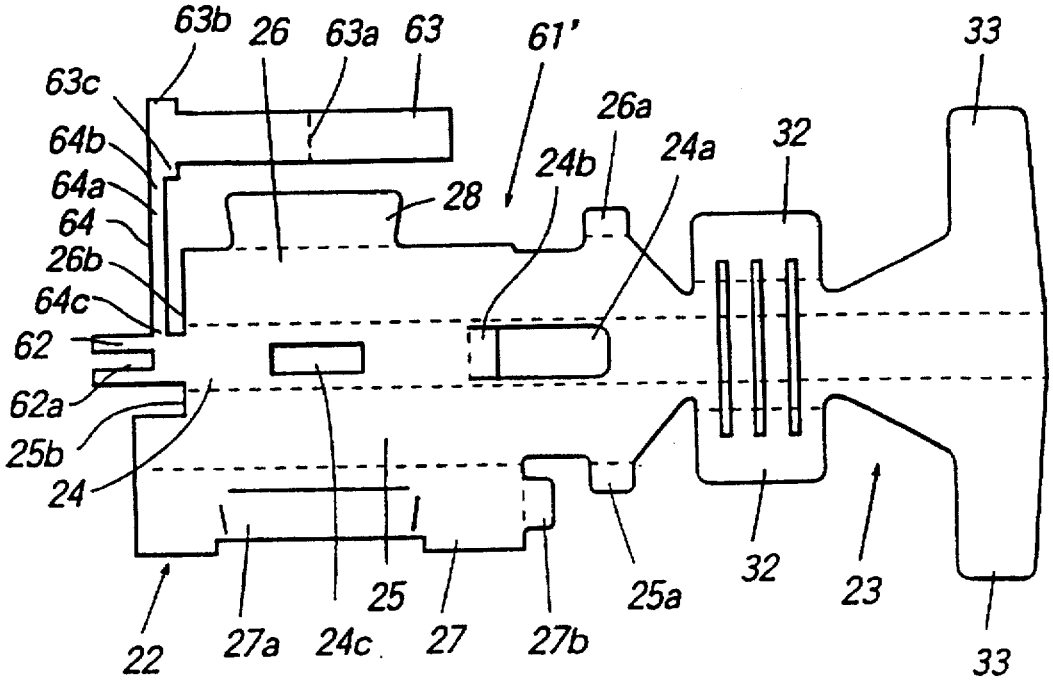
FIG. 14 is a plan view of a blanked plate of the fourth embodiment.

FIG. 14 is a plan view showing a blanked plate 61' of the above mentioned connecting terminal 61 prior to the folding process. The restricting portion 24c is formed in the bottom plate 24 such that it protrudes from the plane of the drawing of FIG. 14, a dovetail depressed portion 27a is formed in the top plate 27, and the top plate 28 is formed in such a shape that it can be clamped into the depressed portion 27a of the top plate 27. Further, in the front end of the bottom plate 24, the clamping lugs 62 are formed to have the guide groove 62a for guiding a rib of a cooperating connecting terminal, the movable contact strip 63 having the contact portion 63a is formed to be coupled with a side of the top plate 28 by means of a bridging strip 64, and the engaging lugs 63b and 63c are formed in the front edge portion of the movable contact strip 63. The remaining structure is similar to that of the previous embodiments.

The movable contact strip 63 in the blanked plate 61' is bent at the contact portion 63a into a shape of an inverted mountain, then the clamping lug 62 is folded back onto the front end portion of the movable contact strip 63 by bending the bridging strip 64 at the folding portion 64*a*, and the side plates 25 and 26 are bent upwardly such that the engaging lugs 63*b* and 63*c* of the movable contact strip 63 are engaged with the front edges 25*b* and 26*b* of the side plates 25 and 26, respectively. The remaining portions are bent in a similar manner to that of the previous embodiments, and finally the bridging strip 64 is cut off at the cut-off portions 64*b* and 64*c*.

In the fourth embodiment explained above, in addition to the advantages obtained by the previous embodiments, it is possible to attain special advantages that the guide groove 62*a* of the clamping lugs 62 can guide a rib of a cooperating connecting terminal and an excessive deformation of the movable contact strip 63 can be prevented by the restricting portion 24*c*.

It should be noted that in the embodiments explained above, the bridging strip for coupling the movable contact strip may not be cut off. In such a case, the movable contact strip can be formed by a separate metal plate which can resist a large load. Then, the connecting terminal for heavy duty use may be obtained.

APPLICABILITY IN INDUSTRY

In the connecting terminal according to the first aspect of the present invention, the engaging projections of the movable contact strip whose contact portion is directed to the top plate are engaged with the engaging portions of the side plates, and therefore the connecting terminal can be sufficiently applied to a cooperating connecting terminal which requires such a construction that the movable contact strip is placed on the bottom plate.

In the connecting terminal according to the second aspect of the present invention, the engaging projections of the movable contact strip whose contact portion is directed to the top plate are engaged with the engaging portion of the bottom plate, and thus the connecting terminal can be sufficiently applied to a cooperating connecting terminal which requires such a construction that the movable contact strip is placed on the bottom plate.

In the method of manufacturing the connecting terminal according to the invention, the movable contact strip is formed near the top plate or side plate in the blanked plate, and therefore a loss of material can be saved. Further, the movable contact strip is folded back onto the bottom plate and then the clamping lug is folded back onto the movable contact strip, so that the connecting terminal can be sufficiently applied to a cooperating connecting terminal which requires such a construction that the movable contact strip is placed on the bottom plate and the connecting terminal can resist a large load upon receiving the cooperating connecting terminal.

I claim:

1. A method of manufacturing a connecting terminal comprising a step of punching a single metal plate to form a bottom plate, side plates extending from respective sides of said bottom plate, a top plate extending from at least one of the side plates and a movable contact strip near said side plate or top plate, said movable contact strip having engaging lugs formed at a front end portion thereof and being coupled with a front end portion of said bottom plate by means of a bridging strip, a step of bending said bridging strip such that the movable contact strip is folded back onto said bottom plate, a step of bending said side plates upwardly such that said engaging lugs of said movable contact strip are engaged with front edges of said side plates, a step of bending said top plate horizontally and a step of cutting off said bridging strip.

2. A connecting terminal comprising a front portion and a rear portion, a connecting portion provided at said front portion, and a clamping portion provided at said rear portion for clamping a wire, said connecting portion including a movable contact strip that is electrically connected to a cooperating connecting terminal, said movable contact strip having an upper contact portion and a front portion with engaging projections, said connecting portion is surrounded by a bottom plate, side plates extending upwardly from sides of said bottom plate and a top plate which is bent horizontally from at least one of said side plates, said bottom plate including a clamping strip with a T-shaped extension, said movable contact strip is arranged on said bottom plate with said engaging projections of said front portion directed toward said top plate, and said clamping strip is bent over backwards to sandwich said front portions of said movable contact strip between bent and unbent portion of said clamping strip, with said engaging projections of said movable contact strip engaging said T-shaped extension of said clamping strip.

* * * * *